US010688674B2

(12) United States Patent
Schaefer et al.

(10) Patent No.: US 10,688,674 B2
(45) Date of Patent: Jun. 23, 2020

(54) PERSONAL CARE PRODUCT HANDLE

(71) Applicant: The Gillette Company LLC, Boston, MA (US)

(72) Inventors: Robert Schaefer, Frankfurt (DE); Christoph Zegula, Frankfurt (DE); Matthias Paschold, Wolmirstedt (DE); Christian Litterst, Frankfurt (DE); Judith von Dahlen, Frankfurt (DE)

(73) Assignee: The Gillette Company LLC, Boston, MA (US)

( * ) Notice: Subject to any disclaimer, the term of this patent is extended or adjusted under 35 U.S.C. 154(b) by 0 days.

(21) Appl. No.: 15/866,564

(22) Filed: Jan. 10, 2018

(65) Prior Publication Data

US 2018/0207819 A1 Jul. 26, 2018

(30) Foreign Application Priority Data

Jan. 20, 2017 (EP) ..... 17152538

(51) Int. Cl.

| | |
|---|---|
| ***B26B 19/38*** | (2006.01) |
| ***A45D 27/29*** | (2006.01) |
| ***H01F 7/02*** | (2006.01) |

(52) U.S. Cl.

CPC ..... *B26B 19/3853* (2013.01); *A45D 27/29* (2013.01); *B26B 19/3873* (2013.01); *H01F 7/0242* (2013.01)

(58) Field of Classification Search

CPC ..... B26B 19/3853; B26B 19/3873; H01F 7/0242; A45D 27/29

USPC ..... 30/526

See application file for complete search history.

(56) References Cited

U.S. PATENT DOCUMENTS

| | | | | | |
|---|---|---|---|---|---|
| 3,283,185 | A * | 11/1966 | Tolmie | B26B 19/28 | 30/34.05 |
| 5,138,245 | A * | 8/1992 | Mattinger | B26B 19/286 | 30/DIG. 1 |
| D339,655 | S * | 9/1993 | Sulik | D28/53 | |
| 5,966,821 | A * | 10/1999 | Armbruster | B26B 19/3833 | 242/400.1 |
| 6,112,414 | A * | 9/2000 | Andis | B26B 19/3826 | 30/231 |
| D456,096 | S * | 4/2002 | Rizzuto, Jr. | D28/53 | |
| D586,955 | S * | 2/2009 | Eigenstetter | D28/53 | |
| 7,733,058 | B2 * | 6/2010 | Takaoka | A45D 27/46 | 320/114 |
| 10,104,950 | B1 * | 10/2018 | Provost | A45D 27/29 | |

(Continued)

FOREIGN PATENT DOCUMENTS

| | | |
|---|---|---|
| WO | WO 94/27479 | 12/1994 |
| WO | WO 2010/134051 | 11/2010 |

OTHER PUBLICATIONS

PCT International Search Report with Written Opinion in corresponding international application PCT/US2018/013238 dated Apr. 12, 2018.

(Continued)

*Primary Examiner* — Hwei-Siu C Payer

(74) *Attorney, Agent, or Firm* — John M. Lipchitz

(57) ABSTRACT

A personal care product having a handle is provided. The handle has a handle resting plane and at least one docking magnet positioned within an end portion. The docking magnet has an axis of polarity that intersects the handle resting plane at an included angle of less than 35 degrees.

13 Claims, 10 Drawing Sheets

(56) References Cited

U.S. PATENT DOCUMENTS

| | | | | |
|---|---|---|---|---|
| 2004/0172831 | A1* | 9/2004 | Paas | B26B 21/38 30/45 |
| 2008/0052912 | A1 | 3/2008 | Barry et al. | |
| 2009/0056141 | A1* | 3/2009 | Barry | A45D 27/29 30/41.7 |
| 2012/0217930 | A1* | 8/2012 | Taniguchi | A45D 27/46 320/115 |
| 2016/0296078 | A1* | 10/2016 | Beckerman | A46B 5/002 |
| 2018/0206611 | A1* | 7/2018 | Schaefer | A45D 27/29 |
| 2018/0207819 | A1* | 7/2018 | Schaefer | B26B 19/3853 |
| 2018/0207820 | A1* | 7/2018 | Schaefer | B26B 19/3853 |

OTHER PUBLICATIONS

EPO Search Report with Written Opinion in corresponding EPO application 17152538.9 dated Apr. 24, 2017.

U.S. Appl. No. 15/866,623, filed Jan. 10, 2018, Robert Schaefer et al.

U.S. Appl. No. 15/866,646, filed Jan. 10, 2018, Robert Schaefer et al.

* cited by examiner

PERSONAL CARE PRODUCT HANDLE

FIELD OF THE INVENTION

The present disclosure provides for a docking system for a personal care product.

BACKGROUND OF THE INVENTION

Personal care products include dry shaving razors and wet shaving razors, among other types of grooming and hygiene-related implements. An example of a dry shaving razor is an electric razor, which can be used without water, soap, or shaving cream. Wet shaving razors are typically used with water and soap or shaving cream. A wet shaving razor can include a replaceable cartridge in which one or more blades are mounted in a housing. After the blades in a cartridge have become dull from use, the cartridge is discarded, and a new cartridge is replaced on the handle.

Personal care products are often stored on a sink, in a medicine cabinet, or on a shelf between uses. Many personal care products are considered commodity consumer articles, having relatively low-price points. Due in part to the low price point of various personal care products, consumers may have reduced expectations in regard to aesthetics, style, functionality, and ease of use. Rechargeable personal care products can have a much higher price point, but are often more expensive to manufacture because of the added cost for the rechargeable power source and the associated electronics. Accordingly, rechargeable personal care products must not only perform very well, but must also be aesthetically pleasing to justify the higher purchase price.

Thus, it would be advantageous to provide for a personal care product that addresses one or more of these issues. Indeed, it would be advantageous to provide for a personal care product providing for storing a personal care product in an aesthetically pleasing manner, thereby allowing a user to leave the personal care product in view between uses while the personal care product is charging. It would also be advantageous to provide a personal care product that is perceived as a premium product in view of its usability, functionality, looks, among other characteristics, especially when the personal care product is connected to a power source while charging.

SUMMARY OF THE INVENTION

The present disclosure fulfills the needs described above by, in one embodiment, providing a personal care product system comprising a personal care product stand having a resting plane and a handle having an elongated gripping portion. The handle is suspended at an angle relative to the personal care product stand and has a handle resting plane that intersects the resting plane of the personal care product stand at an included angle of less than 90 degrees. The handle has an unsupported length that is not engaged with the personal care product stand and that is 90% to 100% of an overall length of the handle.

In another embodiment, a personal care product stand comprises a base having a resting plane, a center axis, and a top surface defining a handle receiving portion that is configured to hold a handle. The base defines a cavity and at least one permanent docking magnet is positioned within the cavity at least 10 mm from a center axis of the base.

In yet another embodiment, a personal care product comprises a handle having an elongated gripping portion. The handle has a handle resting plane and an end portion. A first docking magnet is positioned within the end portion. The first docking magnet has an axis of polarity that intersects the handle resting plane at an included angle of 15 degrees to 35 degrees.

BRIEF DESCRIPTION OF THE DRAWINGS

The above-mentioned and other features and advantages of the present disclosure, and the manner of attaining them, will become more apparent, and the disclosure itself will be better understood by reference to the following description of nonlimiting embodiments of the disclosure taken in conjunction with the accompanying drawings, wherein.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents, and other references mentioned herein are incorporated by reference in their entirety. In case of conflict, the present specification, including definitions, will control. In addition, the materials, methods, and examples are illustrative only and not intended to be limiting.

Other features and advantages of the invention will be apparent from the following detailed description, and from the claims.

DETAILED DESCRIPTION OF THE INVENTION

The present disclosure provides for personal care product systems having a handle and a personal care product stand for docking the handle when not in use. Various nonlimiting embodiments of the present disclosure will now be described to provide an overall understanding of the principles of the function, design, and operation of the personal care product systems. One or more examples of these nonlimiting embodiments are illustrated in the accompanying drawings. Those of ordinary skill in the art will understand that the methods described herein and illustrated in the accompanying drawings are nonlimiting example embodiments and that the scope of the various nonlimiting embodiments of the present disclosure are defined solely by the claims. The features illustrated or described in connection with one nonlimiting embodiment may be combined with the features of other nonlimiting embodiments. Such modifications and variations are intended to be included within the scope of the present disclosure.

Figure 1:
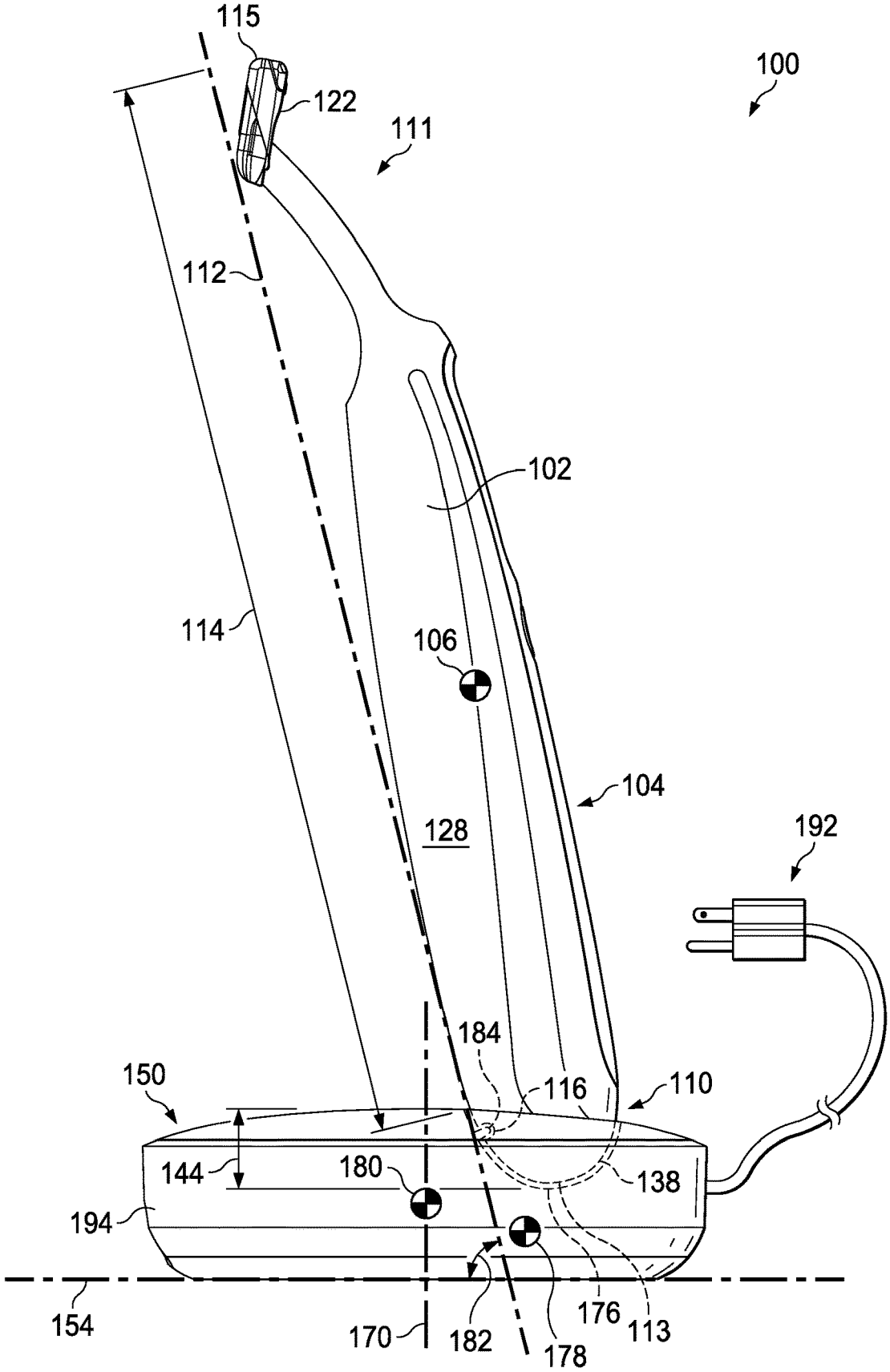
FIG. 1 is a side view of an exemplary personal care product system in accordance with one nonlimiting embodiment of the present disclosure.

Referring now to FIG. 1, a side view of an exemplary personal care product system 100 is depicted in accordance with one nonlimiting embodiment of the present disclosure. The personal care product system 100 comprises a handle 102 that is docked with a personal care product stand 150. While the handle 102 is shown as a rechargeable wet razor having powered components, such depiction is for illustrative purposes only. Other examples of personal consumer products that can be docked to the personal care product stand 150 may include, without limitation, dry razors, epilators or other hair cutting and/or epilating household devices, trimmers, personal groomers, toothbrushes, hair removal devices, and so forth. Further, while a shaving razor cartridge 122 having blades is depicted as being coupled to a distal end of a second end portion 111 of the handle 102, in other embodiments the handle 102 may additionally or alternatively include other types of grooming devices, such as perforated shaving foils, rotary cutters, oscillating cutters, trimmers, and so forth. Accordingly, the handle 102 with the depicted shaving razor cartridge 122 coupled to the second end portion 111 is for illustrative purposes only and is not intended to limit the disclosure to any particular configuration of the handle 102, the personal care product system 100, or the shaving razor cartridge 122. The handle 102 may include one or more powered elements, such as fluid pumps, motors, sensors, vibrating or oscillating components, heating elements, and so forth. As used herein, the term handle 102 is to refer to the personal grooming device that can be stored in the personal care product stand 150, including any attachable components, such as the shaving razor cartridge 122. Any lengths, measurements or calculations of center of gravity, center of mass, etc. are to be determined with the shaving razor cartridge, or other associated grooming implement, attached to the handle 102. Further, while the handle 102 is shown to have a generally cylindrical elongated gripping portion 104, this disclosure is not so limited. Instead, the elongated gripping portion 104 can be any suitable shape, size, or configuration and is the portion of the handle 102 that is handled by the user during use of the personal care product.

The shaving razor cartridge 122 (or other type of attachment or fixed implement) may be fixedly or pivotably mounted to the handle 102, depending on the overall desired cost and performance. The shaving razor cartridge 122 may be permanently attached or removably mounted to the handle 102. The shaving razor cartridge 122 may include one or more blades 123 (FIG. 2), or other cutting instruments. The handle 102 may hold a power source 119 (FIG. 3) that supplies power to one or more of the onboard powered elements, such as a heating element, a motor, a vibrating element, or other type of element driven by electricity. The power source may be a rechargeable battery that may be recharged while the handle 102 is docked in the personal care product stand 150 while not in use.

The handle 102 is shown in a docked position in FIG. 1. While in the docked position, at least a portion of a first end portion 110 of the handle 102 can be received into a personal care product stand 150, as described in more detail below. The personal care product stand 150 can include a base 194 and a power plug 192 that can be plugged into a power source, such as a wall outlet. The personal care product stand 150 can further include a base charging system 148 (FIG. 4) that delivers power to a handle charging system 146 (FIG. 3) of the handle 102 when the personal care product stand 150 is connected to a power source and the handle 102 is docked to the personal care product stand 150. While the power plug 192 is shown in FIG. 1 as being a conventional wall plug, in other configurations different power plug configurations can be used, such as USB chargers, for example. In yet other embodiments, the personal care product stand 150 comprises a rechargeable power source that is configured to store power and then charge the handle 102 when it is docked with the stand.

While the personal care product stand 150 is shown as having a generally puck-shaped base 194, the personal care product stand 150 can be any suitable shape that can rest on a flat surface. A stand resting plane 154 shown in FIG. 1 depicts the flat surface that the personal care product stand 150 can rest on, such as a shelf, tabletop, sink, etc. As is to be appreciated, the personal care product stand 150 can also include feet or other nubs which contact the stand resting plane 154 defined by the flat surface. The personal care product stand 150 also defines a handle mounting surface 176. When the handle 102 is in the docked position, at least a portion of the handle mounting surface 176 may contact a personal care product stand contact area 138 of the handle 102, as described in more detail below.

The base 194 of the personal care product stand 150 also defines a geometrical center 180, sometimes referred to as a centroid, as well as a center of mass 178. The base 194 may be configured such that the center of mass 178 may be spaced apart from the geometrical center 180 and positioned toward the handle mounting surface 176 such that the center of mass 178 is horizontally offset from the geometrical center 180. Positioning the center of mass 178 toward the handle mounting surface 176 can increase the stability of the personal care product stand 150 when the handle 102 is being docked or undocked by a user. While the amount of horizontal offset between the geometrical center 180 and the center of mass 178 may vary based on the configuration of the personal care product stand 150, in some configurations the center of mass 178 is horizontally offset from the geometrical center 180 towards the handle mounting surface 176 by at least about 4 mm. In some configurations, as shown in FIG. 1 the center of mass 178 is vertically positioned between the handle mounting surface 176 and the stand resting plane 154.

Figure 2:
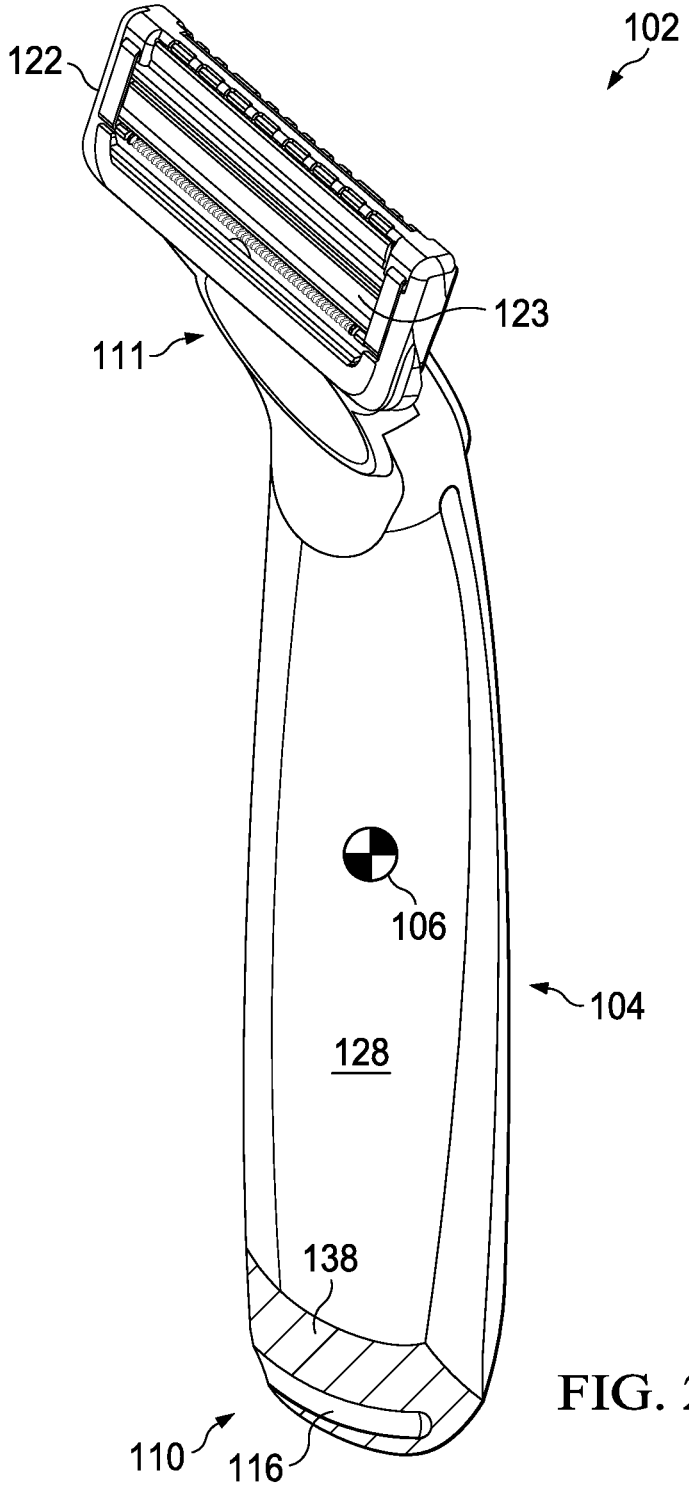
FIG. 2 is an isometric view of a handle.
Figure 3:
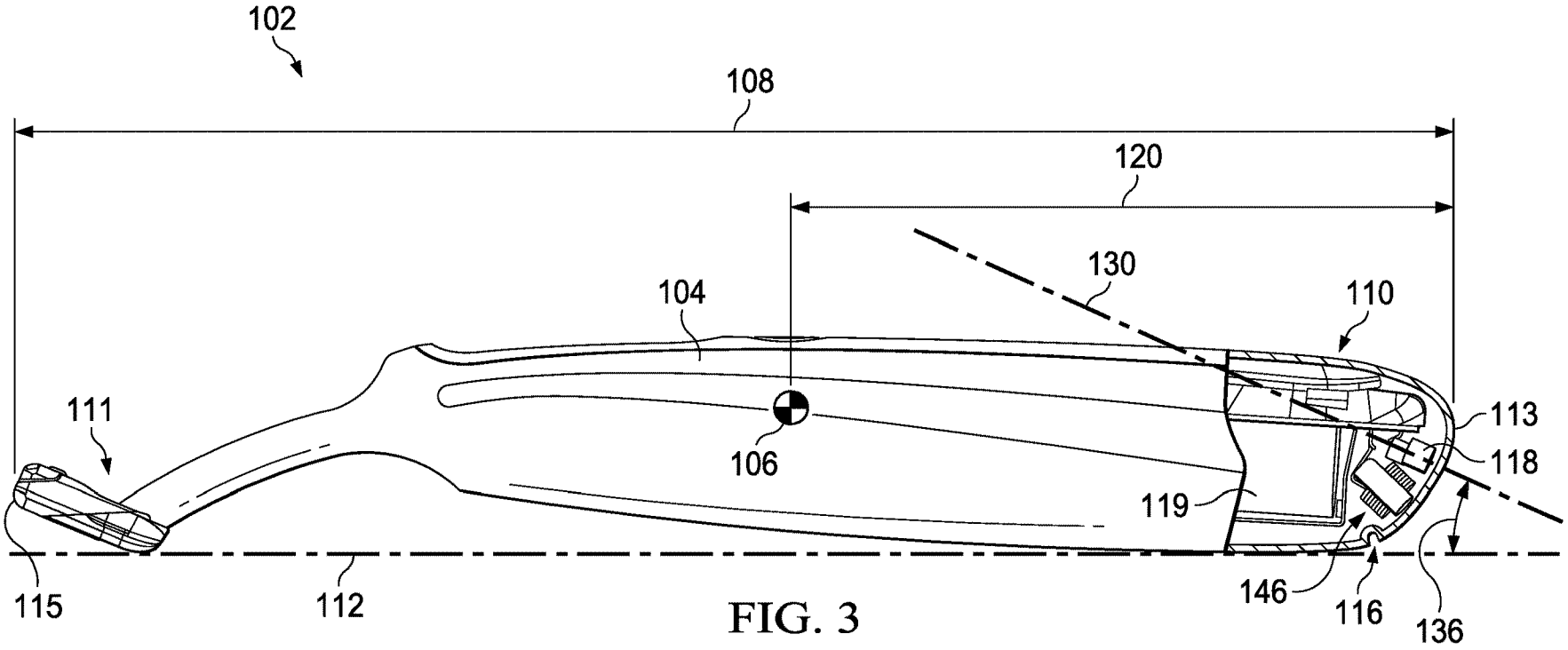
FIG. 3 is a side view of the handle shown in FIG. 2 with a cutaway view of a first end portion.

FIG. 2 depicts an isometric view of the handle 102 and FIG. 3 is a side view of the handle 102 with a cutaway view of the first end portion 110. Referring now to FIGS. 1-3, the handle 102 has an overall length 108 (FIG. 3), as measured from the most proximal point of the first end portion 110 (shown as point 113) to the most distal point (shown as point 115) on the shaving razor cartridge 122 (or other grooming implement operationally coupled to the handle 102). In some configurations, the overall length 108 of the handle 102 is between about 130 mm and about 170 mm. In some configurations, the overall length 108 of the handle 102 is between about 150 mm and about 160 mm. The handle 102 also defines a center of mass 106. The center of mass 106 of the handle 102 is spaced apart from the most proximal point of the first end portion 110 by about 30 mm to about 80 mm, shown as spacing 120 in FIG. 3. As shown in FIG. 3, when the handle 102 rests on a flat surface (e.g., sink, shelf, etc.)

with the blades 123 (FIG. 2) of the shaving razor cartridge 122 facing the flat surface, the flat surface defines a handle resting plane 112.

The relative position of the handle resting plane 112 to the stand resting plane 154 of the personal care product stand 150 when the handle 102 is docked is shown in FIG. 1. As shown, the personal care product stand 150 has a center axis 170 that is perpendicular to the stand resting plane 154 and extending through the geometrical center 180. When in the docked position, the handle 102 is tilted relative to the center axis 170. As such, the handle 102 is suspended at an angle relative to the personal care product stand 150. In some configurations, the second end portion 111 extends outward beyond the perimeter of the base 194. In order to provide the tilted arrangement, the handle resting plane 112 intersects the stand resting plane 154 of the personal care product stand 150 at an included angle (shown as angle 182 in FIG. 1) of less than 90 degrees. In some configurations, the included angle 182 is between about 60 degrees and 80 degrees. While the handle 102 is tilted, however, a majority of the overall length 108 of handle 102 is unsupported, thereby creating an appearance that the handle 102 is levitated or floating to defy gravity. Only the personal care product stand contact area 138 at the first end portion 110 of the handle 102 contacts the personal care product stand 150, with a remaining surface 128 of the handle 102 suspended without touching the base 194 or other type of physical support.

Referring to FIG. 1, an unsupported length 114 is the portion of the handle 102 extending upward from the personal care product stand 150, the entirety of which is free-standing and not engaged with or otherwise contacting a structural element. The unsupported length 114 can be about 90% to 100%, but more preferably 92% to 96% of the overall length 108 (FIG. 3) of the handle 102. Further, the personal care product stand contact area 138 of the handle 102 may be entirely positioned within a lower 10% of an overall length 108 of the handle 102. In some configurations, the personal care product stand contact area 138 of the handle 102 may be entirely positioned within a lower 10% of an overall length 108 of the handle 102, or more preferably with a lower 6% of the overall length 108 of the handle 102. In some configurations, the personal care product stand contact area 138 of the handle 102 may be entirely positioned within a lower 2% of an overall length 108 of the handle 102. In one embodiment, the overall length 108 of the handle 102 is about 158 mm, and the unsupported length 114 is about 150 mm. It is believed the tilted relationship between the handle 102 and the personal care product stand 150 provides for an aesthetically pleasing docking arrangement, as the handle 102 seemingly defies gravity with a minimal amount of structural support from the stand. The docking relationship can also aid a user in placing handle 102 in the personal care product stand 150, while also providing for easy removal. As such, the docking process is eased as the user need only set the handle 102 on the personal care product stand 150 to dock. Similarly, to use the handle 102, the user need only lift the handle 102 away from the personal care product stand 150 to undock.

Figure 4:
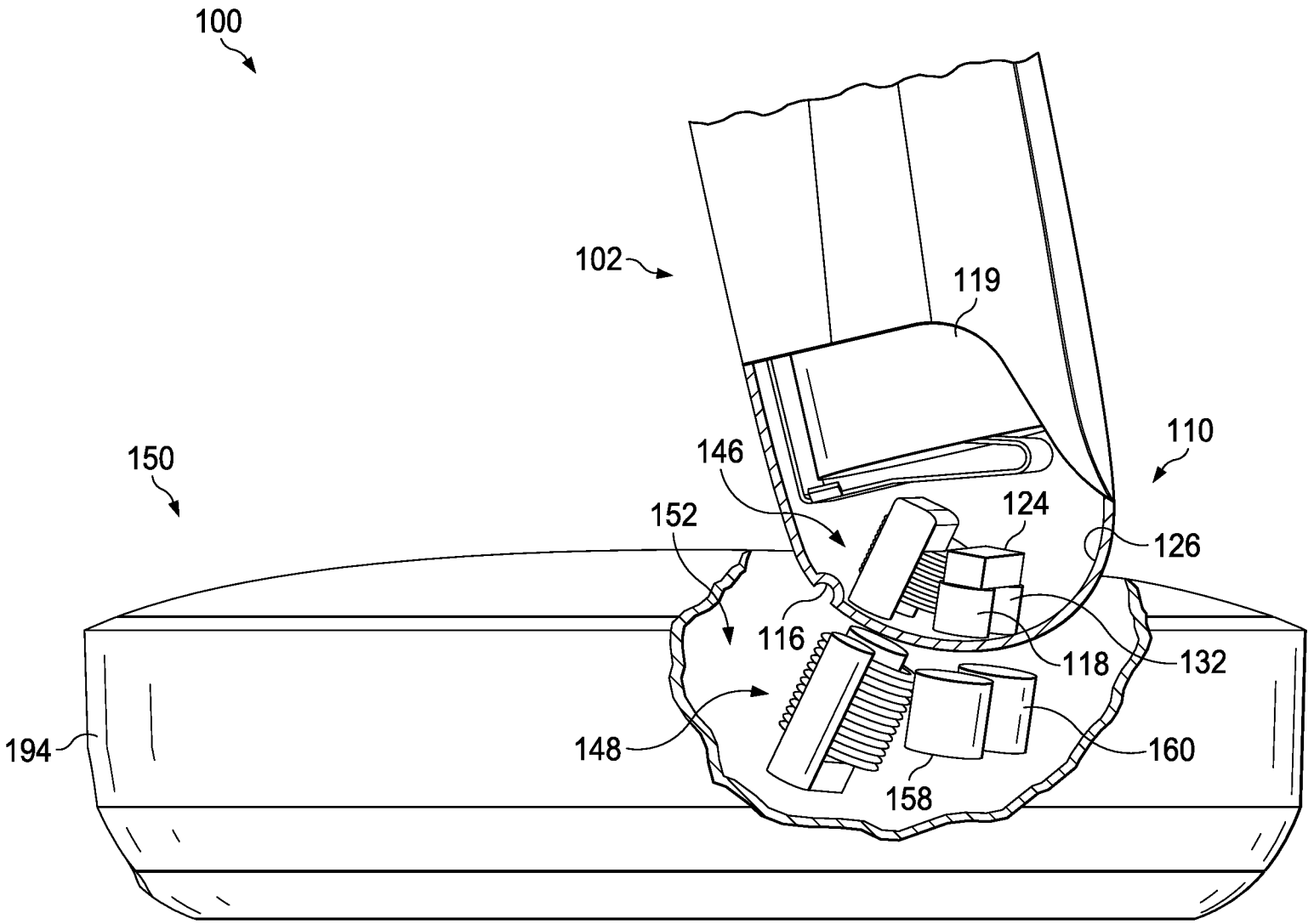
FIG. 4 is a partial cutaway view of a first end portion of a handle that is docked with a personal care product stand, with various components removed for clarity of illustration.

FIG. 4 is a partial cutaway view of the first end portion 110 of the handle 102 docked with the personal care product stand 150, as shown in FIG. 1, with various components removed for clarity of illustration. Each of the handle 102 and the personal care product stand 150 include docking magnets (the handle 102 is shown to include docking magnets 118, 132 and the personal care product stand 150 is shown to include docking magnets 158, 160) that facilitate the docking of the handle 102 to the personal care product stand 150. The relative position and location of the docking magnets 118, 132 of the handle 102 and the docking magnets 158, 160 of the personal care product stand 150 facilitate the visually appealing tilting of the handle 102 relative to the personal care product stand 150, while the handle 102 is substantially unsupported. While the number and shape of docking magnets can vary, in the illustrated configuration, the handle 102 has a first docking magnet 118 that is positioned beside a second docking magnet 132, both of which are substantially cylindrical. Similarly, the personal care product stand 150 has a first docking magnet 158 that is positioned beside a second docking magnet 160, both of which are substantially cylindrical and mounted within a cavity 152 defined by the personal care product stand 150.

Depending upon the functionality provided by the handle 102, the handle 102 may also have a handle charging system 146 that is configured to receive power from a base charging system 148 when the handle 102 is docked to the personal care product stand 150. The handle charging system 146 can use the power received from the base charging system 148 to recharge the power source 119 of the handle 102. In the illustrated configuration, each of the handle charging system 146 and the base charging system 148 comprises at least one coil that facilitates induction charging. As shown in FIG. 4, the handle charging system 146 is positioned in close proximity to the first docking magnet 118 and the second docking magnet 132. Similarly, the base charging system 148 is positioned in close proximity to the first docking magnet 158 and the second docking magnet 160.

When the handle 102 is being docked, the personal care product stand contact area 138 is placed in contact with the handle mounting surface 176, such that the docking magnets 118, 132 of the handle 102 are positioned proximate to the docking magnets 158, 160 of the personal care product stand 150. Once in this position, the magnetic attraction between the docking magnets maintains the titled position of the handle 102 relative to the personal care product stand 150 to overcome the gravitational force acting upon on the handle 102. The handle 102 can remain in this position until the user lifts the handle 102 off the personal care product stand 150.

The personal care product stand 150 also has a ballast mass 162 (FIG. 9) which generates additional gravitational force. In some configurations, the ballast mass 162 is over half the total stand mass, although this disclosure is not so limited. As provided above, the shape and placement of the ballast mass 162 can be configured to appropriately position the center of mass 178 within the personal care product stand 150. The gravitational force of the total stand mass can be greater than a magnetic attraction between the docking magnets 118, 132 of the handle 102 and the docking magnets 158, 160 of the personal care product stand 150. As such, when a user picks up the handle 102 to break the magnetic connection with the personal care product stand 150, the stand mass of the personal care product stand 150 will keep the personal care product stand 150 from lifting with the handle 102. The relative location of the center of mass 178 of the personal care product stand 150, as described above, can further provide stability during operational use. Thus, the personal care product stand 150 will continue to remain stable on the stand resting plane 154 as the handle is undocked. As is to be appreciated upon consideration of this disclosure, increasing the stand mass can allow for the use of a higher docking force between the handle 102 and the personal care product stand 150. In some embodiments, the stand mass of the personal care product stand is between about 150 grams and 300 grams. In some embodiments, the stand mass of the personal care product stand is about 250 grams, thereby allowing for a docking force between the handle 102 and the personal care product stand 150 of up to about 2 Newtons.

Figure 5:
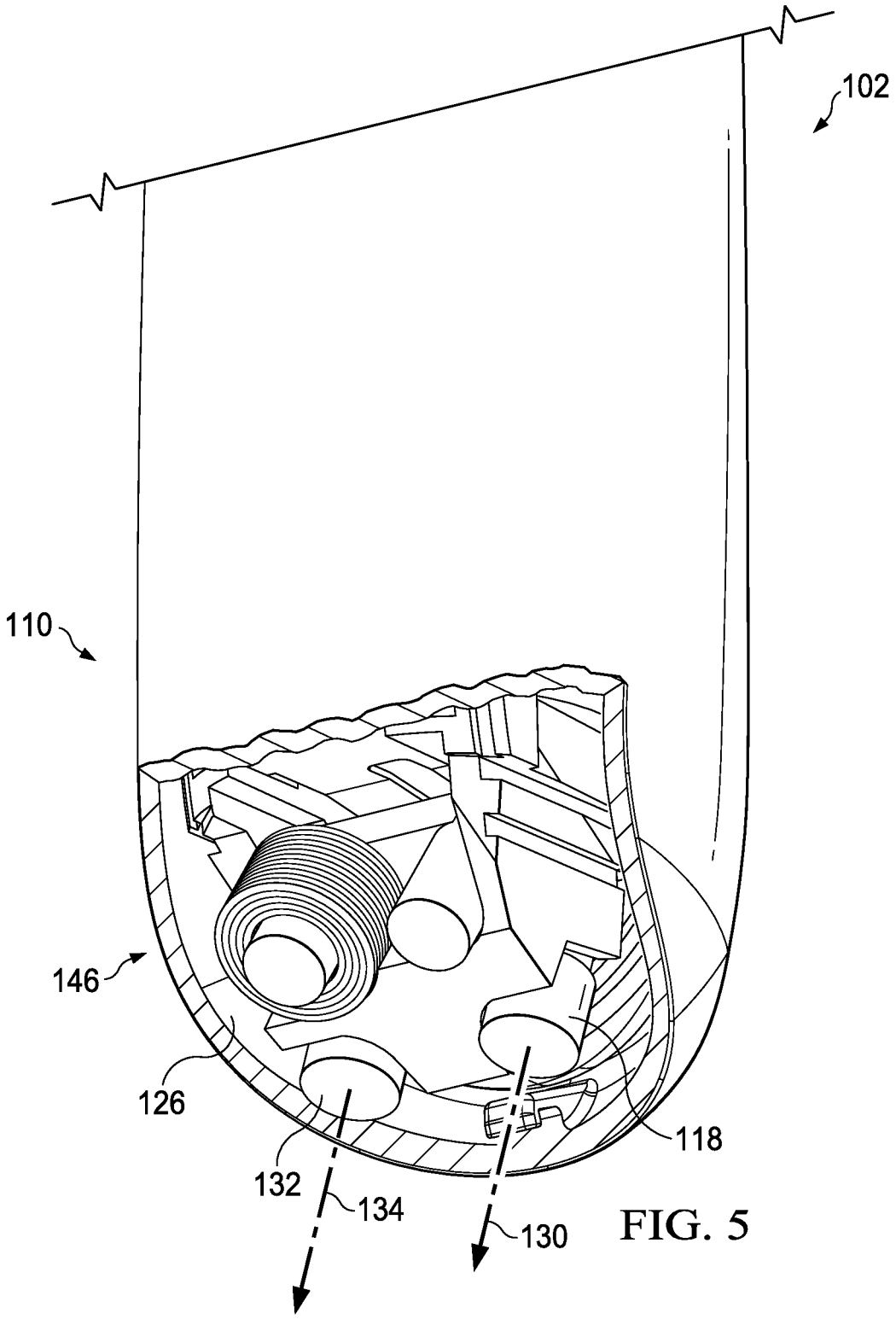
FIG. 5 is a partial cutaway view of a handle showing docking magnets positioned within a first end portion.
Figure 6:
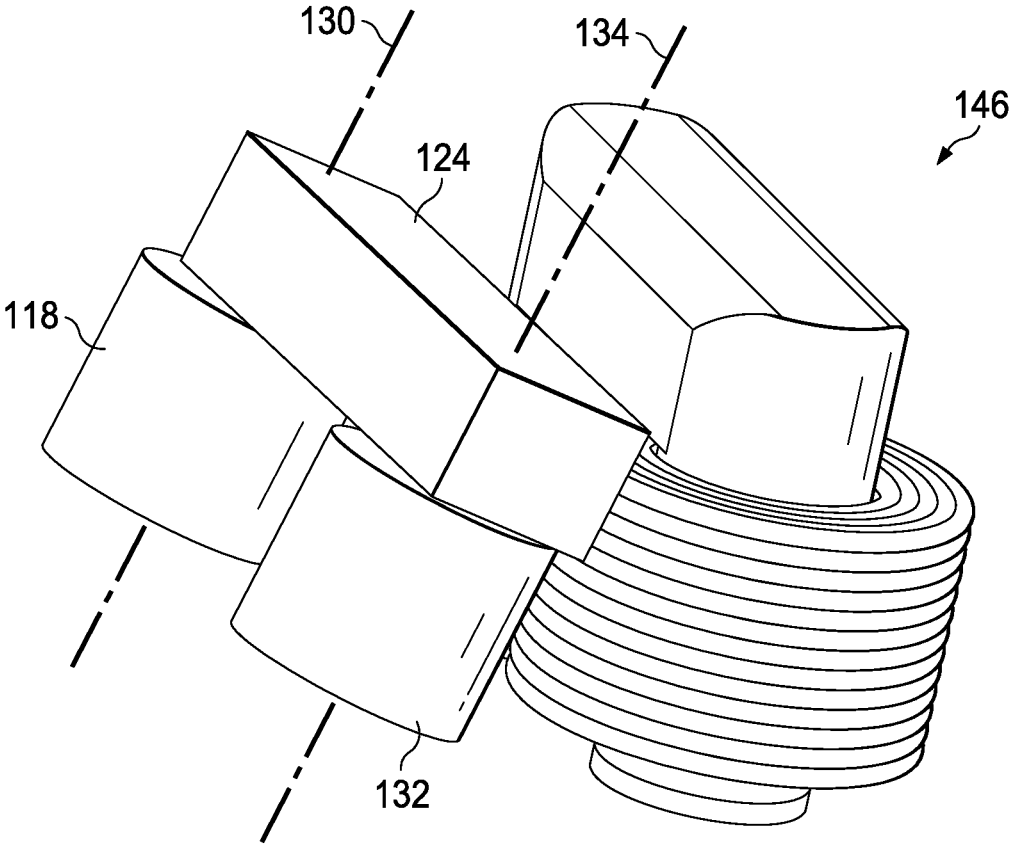
FIG. 6 is an isometric view of docking magnets of a handle with various components removed for clarity of illustration.

FIG. 5 is an isometric partial cutaway view of the handle 102 to show the docking magnets 118, 132 positioned within the first end portion 110. In the illustrated configuration, docking magnets 118, 132 are contacting an inner surface 126 of the personal care product contact area 138 (FIG. 2). FIG. 6 is an isometric view of the docking magnets 118, 132 of the handle 102 with various components removed for clarity of illustration. The polarity of the first docking magnet 118 may be opposite to the polarity of the second docking magnet 132. Additionally, a yoke 124 (FIG. 6) may connect the first docking magnet 118 to the second docking magnet 132. In some configurations, the yoke 124 may be a flux guiding member and may comprise a ferromagnetic material. When functioning as a flux guiding member, the yoke 124 can direct the magnetic fields of the docking magnets 118, 132 so that the impact of these fields on the non-contacting charging capabilities of the handle charging system 146 is reduced. A similar yoke can be used with the docking magnets 158, 160 of the personal care product stand 150 to guide the magnetic fields of those magnets.

Referring to FIGS. 5-6, the first docking magnet 118 defines an axis of polarity 130 that runs through the two poles of the magnet. Similarly, the second docking magnet 132 defines an axis of polarity 134 that runs through the two poles of that magnet. The polarity of the first docking magnet 118 can be opposite of the polarity of the second docking magnet 132. The axis of polarity 130 of the first docking magnet 118 is shown in FIG. 3. The axis of polarity 130 may intersect the handle resting plane 112 at an included angle (shown as included angle 136) which may be between about 15 degrees and about 35 degrees to facilitate the angular position of the handle 102 to the personal care product stand 150.

Figure 7:
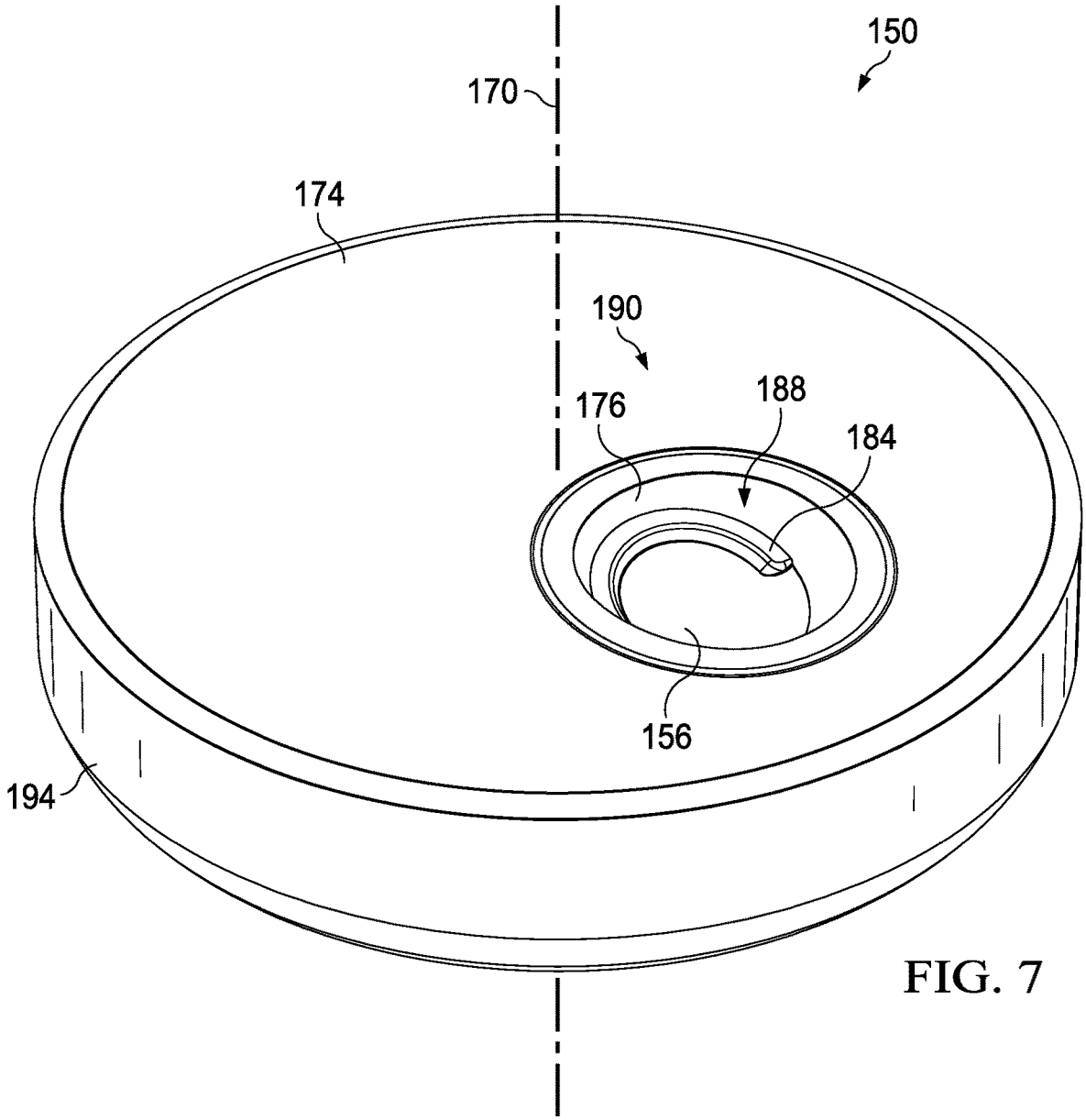
FIG. 7 is an isometric view of one non-limiting example personal care product stand.
Figure 8:
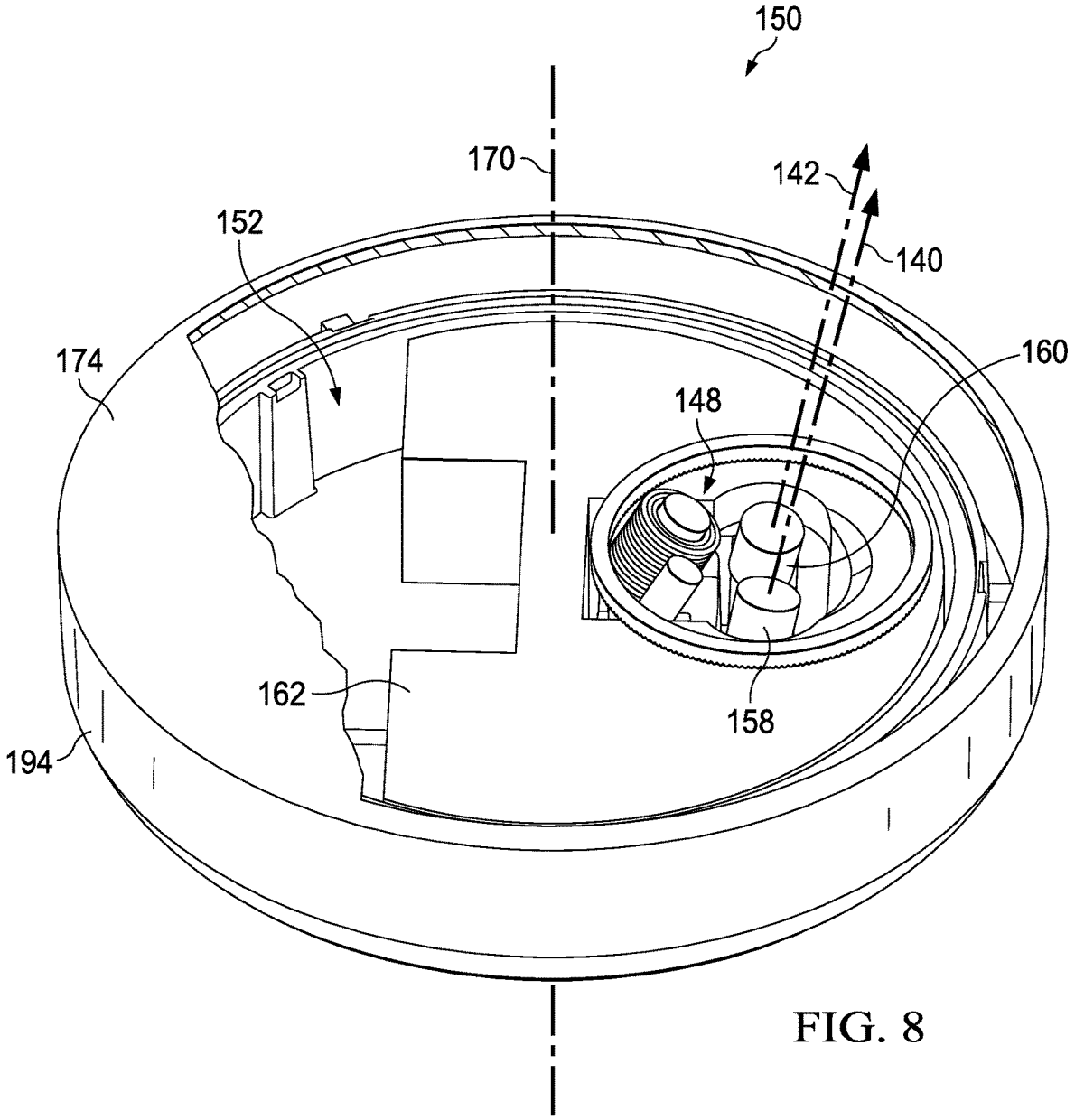
FIG. 8 is a partial cutaway view of the personal care product stand shown in FIG. 7.
Figure 9:
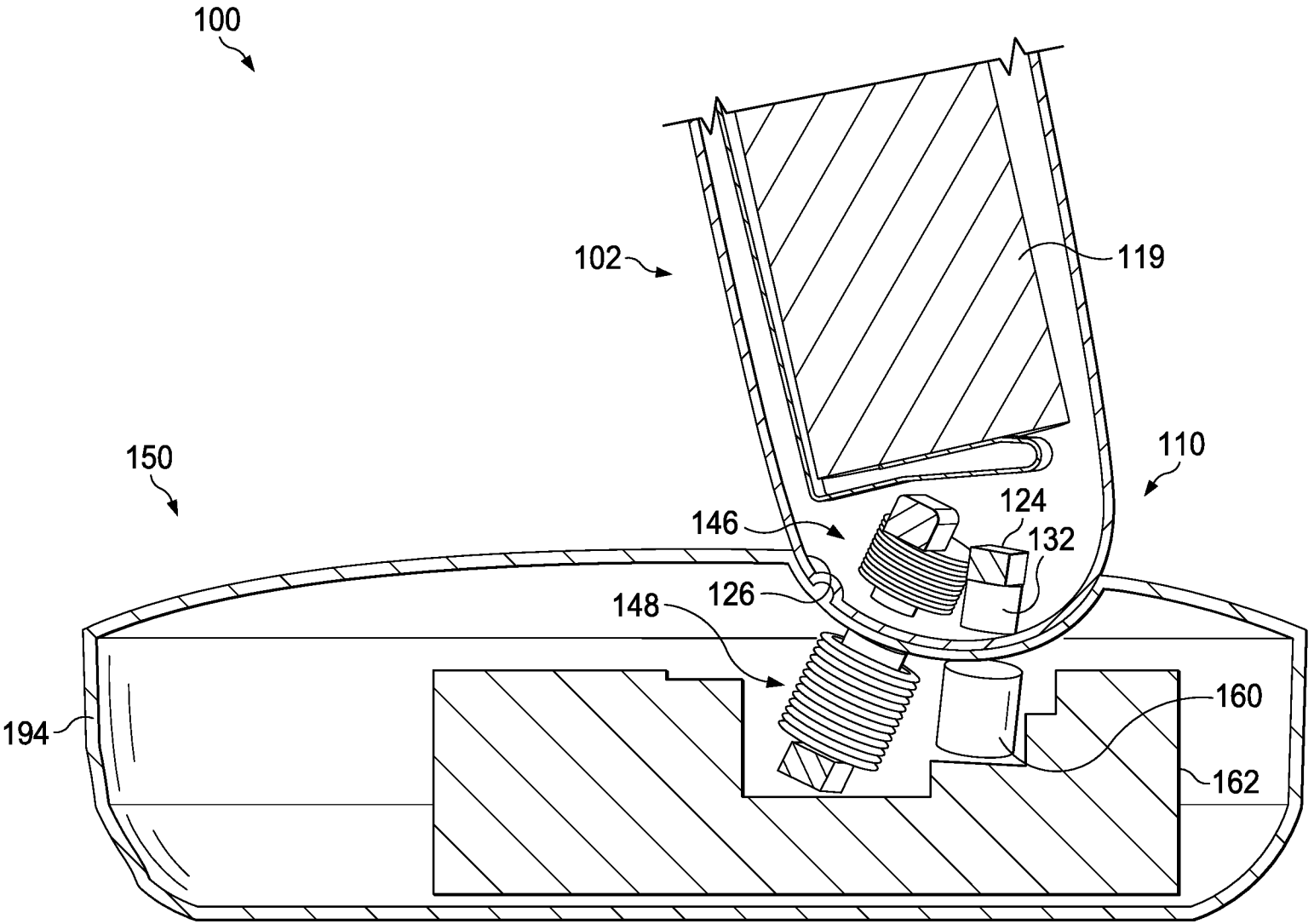
FIG. 9 is a cross-sectional view of the personal care product stand shown in FIG. 7 with a handle of a personal care product docked thereto.

FIG. 7 depicts an isometric view of the personal care product stand 150 and FIG. 8 depicts a partial cutaway view of FIG. 7 to show the internal cavity 152, with various components removed for clarity of illustration. FIG. 9 is a cross-sectional view of the personal care product stand shown in FIG. 7 with the handle 102 of a personal care product docked thereto. The personal care product stand 150 has a top surface 174 that has a handle receiving portion 190 (FIG. 7). The top surface 174 can be planar, rounded, sloped, angled, multi-faceted, or have any other suitable configuration. In some configurations, the handle receiving portion 190 may also define a recess 188 having the handle mounting surface 176 that includes a bottom surface 156. Alternatively, the handle receiving portion 190 may be generally flat or have another suitable arrangement. As shown in the illustrated example, the bottom surface 156 can be non-parallel to the stand resting plane 154 (FIG. 1) of the personal care product stand 150. The recess 188 is sized and configured to receive the first end portion 110 of the handle 102 when the handle 102 is in the docked position. The depth of the recess 188, as measured vertically between the uppermost point and lowermost point (shown as depth 144 in FIG. 1) may be in the range of about 2 mm to about 10 mm. In some configurations, the depth of the recess 188 is about 5.5 mm. The personal care product contact area 138 (FIG. 2) can be received into the recess 188 such that the docking magnets 118, 132 of the handle 102 magnetically engage with the docking magnets 158, 160 of the personal care product stand 150 that are positioned beneath the bottom surface 156. In some configurations, the docking magnets 158, 160 are in contact with the underside of the bottom surface 156, to minimize the distance between the related docking magnets of the handle 102 to increase the magnetic attraction force. The docking magnets 158, 160, as shown in FIG. 8, can each have a respective axis of polarity 140, 142 extending through the poles of the magnet. The polarity of the docking magnet 158 can be opposite of the polarity of the docking magnet 160 and be configured to magnetically engage with the complementary docking magnets 132 and 118 of the handle 102. In some configurations, the axes of polarity 140, 142 can be generally parallel and co-planar to the axes of polarity 130, 134 of the handle 102 when the handle 102 is docked to the personal care product stand 150. In other configurations, the axes of polarity 140, 142 can be generally non-parallel and/or non-planar to the axes of polarity 130, 134 of the handle 102 when the handle 102 is docked to the personal care product stand 150. As shown, the docking magnets 158, 160 may be positioned within the personal care product stand 150 offset from its center. As shown in FIG. 8, the docking magnets 158, 160 can be positioned within the cavity 152 at least 8 mm from the center axis 170, as laterally measured parallel to the stand resting plane 154. In some configurations, the docking magnets 158, 160 can be positioned within the cavity 152 more than about 10 mm from the center axis 170. In some configurations, the docking magnets 158, 160 can be positioned within the cavity 152 more than about 13 mm from the center axis 170.

Referring again to FIG. 7, in accordance with some configurations, the handle receiving portion 190 may comprise an alignment member 184. The alignment member 184 may assist a user with docking the handle 102 in the recess 188, such as to function as a centering feature, to ease the docking process, and to provide consumer feedback that correct alignment between the handle 102 and the personal care product stand 150 is achieved. Proper alignment can assist with ensuring sufficient magnetic coupling between the docking magnets 118, 132 of the handle 102 and the docking magnets 158, 160 of the personal care product stand 150. Proper alignment can assist with sufficient inductive coupling between the base charging system 148 and the handle charging system 146. In some cases, the alignment member 184 provides no mechanical support of the handle 102, but instead merely ensures proper placement of the handle 102 relative to the personal care product stand 150 during docking. In the illustrated embodiment, the alignment member 184 is shown as a ridge that is positioned along a portion of perimeter of the bottom surface 156. Referring to FIG. 3, the first end portion 110 of the handle 102 may have a corresponding alignment member 116 that engages with the alignment member 184 of the personal care product stand 150 when the handle 102 is docked. In the illustrated embodiment, the alignment member 116 is a groove that is sized to receive the ridge positioned in the recess 188 of the personal care product stand 150. As a user directs the handle 102 into the recess 188, the engagement of the alignment member 116 of the handle 102 and the alignment member 184 of the personal care product stand 150 ensures the user is docking the handle 102 at the proper orientation and with the proper angular alignment. While the alignment members 116, 184 are illustrated as an arcuate ridge and groove, this disclosure is not so limited. Instead, the alignment members may be any suitable configurations, such as another type of protrusion and corresponding recess, and the like. As shown in FIGS. 8 and 9, personal care product stand 150 includes a ballast mass 162 which can be sized to provide sufficient mass to position the center of mass 178 (FIG. 1) in a desired position to maintain stability during docking and undocking.

Thus, the ballast mass 162 is positioned such that the center of mass 178 (FIG. 1) is drawn toward the handle receiving portion 190 (FIG. 7) in order to increase stability. The ballast mass 162 can also be sized so that the gravitational force acting upon the base 194 of the personal care product stand 150 is greater than the magnetic attraction between the docking magnets 118, 132 of the handle 102 and the docking magnets 158, 160 of the personal care product stand 150.

Figure 10:
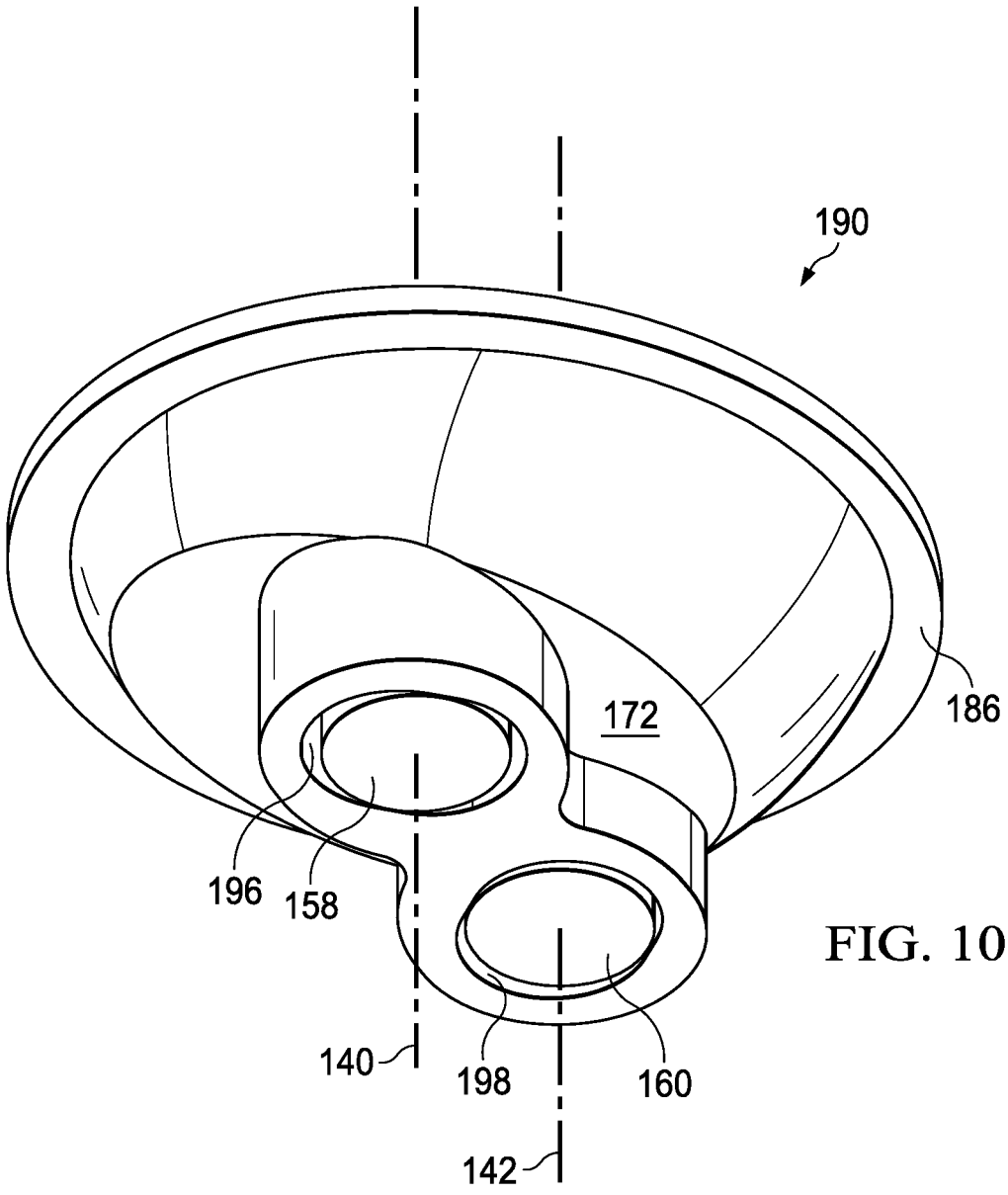
FIG. 10 is a bottom isometric view of a portion of a handle receiving portion that extends into a cavity of a personal care product stand in accordance with one non-limiting embodiment.

FIG. 10 is a bottom isometric view of the portion of the handle receiving portion 190 that extends into the cavity 152 of the personal care product stand 150 in accordance with one non-limiting embodiment. The handle receiving portion 190 can include a gasket 186 to assist with sealing the cavity 152 (FIG. 8). In the illustrated embodiment, the handle receiving portion 190 defines a first pocket 196 and a second pocket 198. As shown, the first docking magnet 158 may be received into the first pocket 196 and the second docking magnet 160 may be received into the second pocket 198 such that they each contact the underside surface of the bottom surface 156 (FIG. 7). In some configurations, the docking magnets 158, 160 are inserted into their respective pockets 196, 198 and fixed by hot stamping, or other assembly techniques. Furthermore, in some configurations the end of the docking magnet facing the bottom surface 156 may be slanted.

Further Non-Limiting Description of the Disclosure

The following paragraphs constitute a further non-limiting description of the disclosure in a form suitable for appending to the claim section if later desired.

A. A personal care product system (100), comprising:

a personal care product stand (150) having a resting plane (154); and a handle (102) having an elongated gripping portion (104), the handle (102) suspended at an angle relative to the base and having a handle resting plane (112) that intersects the resting plane (154) of the personal care product stand at an included angle (182) of less than 90 degrees, wherein the handle has an unsupported length (114) that is not engaged with the personal care product stand and that is about 90% to 100% of an overall length (108) of the handle.

B. The personal care product system of paragraph A wherein the handle (102) has a center of mass (106) spaced apart from a lowermost point of a personal care product stand contact area (138) of the handle by about 30 mm to about 80 mm.

C. The personal care product system according to any one of the paragraphs A and B wherein the handle (102) is not mechanically secured to the personal care product stand (150).

D. The personal care product system according to any one of the paragraphs A-C wherein the handle resting plane (112) intersects the resting plane (154) of the personal care product (150) stand at an included angle (182) of about 60 to about 85 degrees.

E. The personal care product system according to any one of the paragraphs B-D, wherein the personal care product stand contact area (138) is at a first end portion (110) of the handle (102).

F. The personal care product system according to any one of the paragraphs B-E wherein the personal care product stand (150) has a geometrical center (180) that is spaced apart from a handle mounting surface (176) of the personal care product stand (150) that engages the personal care product stand contact area (138) on the handle (102).

G. The personal care product system according to any one of the paragraphs A-F wherein the handle (102) comprises at least a first docking magnet (118) having an axis of polarity (130) that intersects the resting plane (112) at an included angle (136) of about 15 degrees to about 35 degrees.

H. The personal care product system according to paragraph G wherein the handle (102) comprises a second docking magnet (132) having an opposite polarity as a polarity of the first docking magnet (118).

I. The personal care product system according to paragraph H further comprising a yoke (124) connecting the first docking magnet (118) and second docking magnet (132).

J. The personal care product system according to any one of the paragraphs A-I wherein the personal care product stand (150) has a stand mass (162) to form a gravitational force that is greater than a magnetic attraction force between the personal care product stand (150) and the handle (102).

K. The personal care product system according to any one of the paragraphs A-J wherein the personal care product stand (150) has a center of mass (178) that is spaced apart from a geometrical center (180) of the personal care product stand (150) and toward a handle mounting surface (176) on the personal care product stand (150).

L. The personal care product system according to any one of the paragraphs F-K wherein the handle mounting surface (176) on the personal care product stand (150) has an alignment member (184) that engages a corresponding alignment member (116) on the handle (102).

M. The personal care product system according to paragraph L wherein at least one of the alignment members (184, 116) comprises an arc shaped groove or a protrusion.

N. The personal care product system according to any one of the paragraphs F-M wherein the handle mounting surface (176) on the personal care product stand (150) has a recess (188) configured to receive the personal care product stand contact area (138) of the handle (102).

O. The personal care product system according to paragraph N wherein the handle mounting surface (176) on the personal care product stand (150) has an alignment member (184) that engages a corresponding alignment member (116) on the personal care product stand contact area (138) on the handle (102) and the alignment member (184) of the handle mounting surface (176) on the personal care product stand (150) is positioned along a perimeter of a bottom surface (156) of the recess (188).

P. A personal care product stand (150) comprising:

a base (194) having a resting plane (154), a center axis (170) and a top surface (174) defining a handle receiving portion (190) configured to hold a handle (102), the base defining a cavity (152); and at least one permanent docking magnet (158) positioned within the cavity at least 10 mm from a center axis (170) of the base (194).

Q. The personal care product stand of paragraph P wherein the handle receiving portion (190) defines a recess (188) configured to receive a handle.

R. The personal care product stand according to any one of the paragraphs P-Q wherein the handle receiving portion (190) comprises an alignment member (184) configured to engage a corresponding alignment member (116) on a handle (102).

S. The personal care product stand according to paragraph R wherein the alignment member (184) is positioned on a surface (176) of the handle receiving portion (190).

T. The personal care product stand according to paragraph S wherein the alignment member (184) of the handle receiving portion (190) is positioned along a perimeter of a bottom surface (156).

U. The personal care product stand according to paragraph S wherein the alignment member (184) of the handle receiving portion (190) is arcuate.

V. The personal care product stand according to paragraph S wherein the alignment member (184) of the handle receiving portion (190) is a protrusion.

W. The personal care product stand according to paragraph S wherein the alignment member (184) of the handle receiving portion (190) is a recess.

X. The personal care product stand according to any one of the paragraphs P-W wherein the at least one permanent docking magnet (158) positioned within the cavity (152) comprises a pair of permanent docking magnets (158, 160) positioned within the cavity (152).

Y. The personal care product stand according to paragraph X wherein the pair of permanent docking magnets (158, 160) positioned within the cavity (152) have opposing polarities.

Z. The personal care product stand according to any one of the paragraphs P-Y further comprising a ballast mass (162) positioned within the base (194).

AA. The personal care product stand according to any one of the paragraphs P-Z wherein the at least one permanent docking magnet (158) is maintained in a position against an inner surface (172) of the stand directly below the handle receiving portion (190).

BB. The personal care product stand according to any one of the paragraphs P-AA wherein the at least one permanent docking magnet (158) has a slanted end face directly contacting an inner surface (172) directly below the handle receiving portion (190).

CC. The personal care product stand according to any one of the paragraphs P-BB wherein the handle receiving portion (190) is not parallel to the resting plane (154) of the base (194).

DD. A personal care product, comprising:

a handle (102) having an elongated gripping portion (104), the handle (102) having a handle resting plane (112), wherein the handle has an end portion (110) and a first docking magnet (118) positioned within the end portion (110), the first docking magnet (118) having an axis of polarity (130) that intersects the handle resting plane (112) at an included angle (136) of about 15 degrees to about 35 degrees.

EE. The personal care product according to paragraph DD wherein the handle (102) comprises a second docking magnet (132) positioned within the end portion (110).

FF. The personal care product according to paragraph EE wherein the first docking magnet (118) has an opposite polarity as a polarity of the second docking magnet (132).

GG. The personal care product according to any one of the paragraphs EE-FF further comprising a yoke (124) connecting the first docking magnet (118) and the second docking magnet (132).

HH. The personal care product according to any one of the paragraphs DD-GG wherein the first docking magnet (118) is cylindrical.

II. The personal care product according to any one of the paragraphs DD-HH wherein the end portion (110) comprises a personal care product stand contact area (138).

JJ. The personal care product according to paragraph II wherein the personal care product stand contact area (138) is entirely positioned within a lower 6% of an overall length (108) of the handle (102).

KK. The personal care product according to paragraph JJ wherein the personal care product stand contact area (138) is entirely positioned within a lower 2% of an overall length (108) of the handle (102).

LL. The personal care product according to paragraph II wherein the personal care product stand contact area (138) has an inner surface (126) and the first docking magnet (118) is in contact with the inner surface (126).

MM. The personal care product according to any one of the paragraphs II-LL wherein the handle (102) has a center of mass (106) spaced apart from a lowermost point of a personal care product stand contact area (138) of the handle by about 30 mm to about 80 mm.

NN. The personal care product according to any one of the paragraphs DD-MM wherein the end portion (110) of the handle (102) further comprises an alignment member (116).

OO. The personal care product according to paragraph NN wherein the alignment member (116) comprises a groove.

PP. The personal care product according to paragraph NN wherein the alignment member (116) comprises a protrusion.

QQ. The personal care product according to any one of the paragraphs NN-PP wherein the alignment member (116) is positioned within the personal care product stand contact area (138).

RR. The personal care product according to any one of the paragraphs OO-QQ wherein the alignment member (116) is configured to engage a corresponding alignment member (184) on a personal care product stand (150).

The dimensions and/or values disclosed herein are not to be understood as being strictly limited to the exact numerical dimensions and/or values recited. Instead, unless otherwise specified, each such dimension and/or value is intended to mean both the recited dimension and/or value and a functionally equivalent range surrounding that dimension and/or value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A personal care product, comprising:

a handle having an elongated gripping portion, the handle having a handle resting plane, wherein the handle has a first end portion and a second end portion, a first docking magnet is positioned within the first end portion for docking and holding the personal care product on a personal care product stand and a shaving razor cartridge is coupled to the second end portion, the first docking magnet having an axis of polarity that intersects the handle resting plane at an included angle of 15 degrees to 35 degrees.

2. The personal care product of claim 1, wherein the handle comprises a second docking magnet positioned within the first end portion.

3. The personal care product of claim 2, wherein the first docking magnet has an opposite polarity as a polarity of the second docking magnet.

4. The personal care product of claim 2, further comprising a yoke connecting the first docking magnet and the second docking magnet.

5. The personal care product of claim 1, wherein the first docking magnet is cylindrical.

6. The personal care product of claim 1, wherein the first end portion comprises a personal care product stand contact area.

7. The personal care product of claim 6, wherein the personal care product stand contact area is entirely positioned within a lower 5% of an overall length of the handle.

8. The personal care product of claim 7, wherein the personal care product stand contact area is entirely positioned within a lower 2% of the overall length of the handle.

9. The personal care product of claim 6, wherein the personal care product stand contact area has an inner surface and the first docking magnet is in contact with the inner surface.

10. The personal care product of claim 6, wherein the handle has a center of mass spaced apart from a lowermost point of the personal care product stand contact area of the first end portion of the handle by 30 mm to 80 mm.

11. A personal care product, comprising:

a handle having an elongated gripping portion, the handle having a handle resting plane, wherein the handle has an end first portion and a first docking magnet positioned within the first end portion for docking and holding the personal care product on a personal care product stand, the first docking magnet having an axis of polarity that intersects the handle resting plane at an included angle of 15 degrees to 35 degrees, and the first end portion comprises a personal care product stand contact area and an alignment member positioned within the personal care product stand contact area; and a shaving razor cartridge is coupled to a second end portion of the handle.

12. The personal care product of claim 11, wherein the alignment member is selected from the group consisting of a groove and a protrusion.

13. The personal care product of claim 12, wherein the alignment member is configured to engage a corresponding alignment member on the personal care product stand.

* * * * *